United States Patent [19]

Christian

[11] Patent Number: 4,515,385

[45] Date of Patent: May 7, 1985

[54] WHEELCHAIR AND ATTACHMENT THEREFOR

[76] Inventor: Dixon W. Christian, 34 Old Mill Rd., Richmond, Va. 23226

[21] Appl. No.: 504,499

[22] Filed: Jun. 15, 1983

Related U.S. Application Data

[63] Continuation-in-part of Ser. No. 271,135, Jun. 8, 1981, abandoned.

[51] Int. Cl.[3] ..... A61G 15/00

[52] U.S. Cl. ..... 280/289 WC; 297/DIG. 4

[58] Field of Search ..... 280/242 WC, 289 WC, 280/761; 180/6.54; 297/DIG. 4; 248/129

[56] References Cited

U.S. PATENT DOCUMENTS

| | | | |
|---|---|---|---|
| 770,152 | 9/1904 | Bechtel | 248/129 |
| 1,591,529 | 7/1926 | Guerber | 297/433 |
| 1,794,532 | 3/1931 | Nenna | 280/761 |
| 3,120,398 | 2/1964 | Butterworth | 280/761 |
| 3,404,884 | 10/1968 | Sorenson et al. | 248/129 |
| 4,098,521 | 7/1978 | Ferguson et al. | 280/242 WC |

FOREIGN PATENT DOCUMENTS

| | | | |
|---|---|---|---|
| 484786 | 7/1952 | Canada | 280/242 WC |

*Primary Examiner*—Joseph F. Peters, Jr.
*Assistant Examiner*—Ross Weaver
*Attorney, Agent, or Firm*—Norman B. Rainer

[57] ABSTRACT

An improvement is made in a wheelchair having front caster wheels and rear drive wheels whereby the seated occupant can unaidedly cause the wheelchair to have lateral mobility and can remove the drive wheels. Said modification is achieved by jacking apparatus associated with each drive wheel. The jacking apparatus has a lever adapted to be moved to a self-locking position which downwardly urges a connecting rod causing telescopic displacement of a rear caster wheel. Said downward displacement of the rear caster wheel lifts the rear drive wheel off the underlying support surface.

6 Claims, 5 Drawing Figures

WHEELCHAIR AND ATTACHMENT THEREFOR

RELATED APPLICATIONS

This application is a continuation-in-part of U.S. patent application Ser. No. 271,135, filed June 8, 1981, now abandoned.

BACKGROUND OF THE INVENTION

This invention concerns improvements in wheelchairs, and more particularly relates to an improved wheelchair wherein the wheelchair-reliant person can without assistance modify the dimensional and mobility characteristics of said wheelchair.

Wheelchairs are generally constructed having a pair of small forward wheels, each supported by an overhead pivoted yoke which permits the wheel to turn 360° about a vertical axis, and a pair of opposed large rear wheels positioned at each side of the chair on horizontally disposed axles which permit rotation of said rear wheels in fixed vertical planes. The rear wheels, when simultaneously pushed or pulled by the disabled occupant propel the wheelchair in forward or rearward directions.

When one rear wheel is pushed more than the other, or when one rear wheel is pushed while the other is maintained motionless or pulled in the reverse direction, the wheelchair can be made to perform turning motions. One motion however, that the conventional wheelchair is incapable of is a lateral or sideways translational motion in the direction of th horizontal axles of the rear wheels. Such sideways motion is particularly valuable in confined quarters such as an office, workshop or factory environment which cannot accommodate the size or turning radius of the large rear wheels, and where omnidirectional movement is necessary. Such omnidirectional movement, where allowed by the wheelchair, would be caused by the seated occupant by exerting pulling or pushing force against stationary objects within his reach.

Wheelchairs having removable rear wheels have been disclosed in U.S. Pat. No. 4,098,521 to Ferguson et al. The feature of optional removability of the rear wheels affords the following advantages:

(a) easier storage of the wheelchair, particularly in an automobile, (b) eliminates the need of the user to lift or be lifted above the top of the rear wheels for sideways transfer from or to the seat which is generally below the top of the rear wheels, and (c) narrowing of the lateral size of the wheelchair, thereby facilitating passage through narrow aisles.

Although the Ferguson wheelchair permits removal of the large rear wheels while the occupant is seated in the wheelchair, said removal of the wheels cannot be done unaidedly by the seated occupant himself. Another person is needed, who will stand behind the wheelchair and push down on its framework to cause a rearward tilting movement that lifts the drive wheels off the ground. Only when such tilting motion is provided by another individual, can the drive wheels be removed. Also, the same assistance will be needed by the wheelchair occupant when it is desired to have the drive wheels re-installed. Once the drive wheels are removed from the Ferguson et al wheelchair, it is of narrower width, but still lacks omnidirectional movement. Therefore, Ferguson et al expresses the concept of narrowing the width, but is completely silent on the concepts of: (a) enabling the occupant to unaidedly remove and replace the wheels, and (b) causing the wheelchair to be omnidirectional once the drive wheels are removed It is accordingly an object of the present invention to provide a wheelchair having opposed large rear wheels mounted on horizontal axles, said wheels being removable and re-installable by the seated occupant of said wheelchair without assistance from others.

It is a further object to provide wheelchair of the aforesaid nature wherein said wheels may be safely removed by said occupant unaidedly by the performance of two separate and sequential manipulations.

It is another object of this invention to provide a wheelchair capable of motion in the direction of said horizontal axles.

It is a further object to provide a wheelchair of the aforesaid nature which, by a single manipulation rapidly achievable by the seated occupant, can be modified so as to have omnidirectional rolling mobility.

It is a still further object of this invention to provide apparatus which can be attached to a conventional wheelchair to achieve the foregoing objects.

These objects and other objects and advantages of the invention will be apparent from the following description.

SUMMARY OF THE INVENTION

The above and other beneficial objects and advantages are accomplished in accordance with the present invention by an improvement in an otherwise conventional wheelchair comprised of a frame having paired front and rear vertical posts, front caster wheels mounted on said frame adjacent said front posts, seating means associated with said frame generally behind and above said front caster wheels, and a pair of rear drive wheels rotatably supported by said rear vertical posts on opposite sides of said seating means and adapted to rotate in vertical planes about horizontally disposed axles, said drive wheels preferably being equipped with quick disconnect means to facilitate their removal from and return to said wheelchair.

The improvement of the present invention comprises jacking apparatus capable of lifting at least the rear portion of the wheelchair to an elevated height where said drive wheels are no longer resting upon the support surface for said wheelchair. Rear caster wheels associated with said jacking apparatus engage said support surface when the wheelchair is at said elevated height. The jacking apparatus is associated with the horizontal axles of said drive wheels. Lever components of said jacking apparatus are situated within reach of the occupant seated in the wheelchair, and are adapted for movement in substantially vertical planes.

In a preferred embodiment, the rear caster wheels are telescopically engaged with the frame in a downwardly directed manner such that, when not in operative position, the distance between the center of a horizontally disposed axle and the lowermost portion of an associated rear caster wheel is less than the radius of the drive wheel. In such non-operative or stand-by position, the rear caster wheels do not contact the support surface. When placed in operational position by means of said levers, the distance between each center of the horizontally disposed axles and lowermost portion of the associated rear caster wheels becomes greater than the radius of the drive wheels, thereby causing the lowermost portions of the drive wheels to rise from contact with the support surface.

The wheelchair may be of a conventional foldable construction, and said seating means may have flexible seatrest and backrest portions. Removable foot and leg supports may be associated with the forward end of the wheelchair. Armrest members may be associated with said seating means, and clothing protectors may be vertically disposed between said armrest members and the lowermost extremity of said seating means. A circular handrail may be coaxially associated with each of said drive wheels to facilitate their manipulation.

The term caster wheel, as employed herein, is intended to denote a wheel pivotably mounted from above in a manner permitting rotation in a vertical plane and 360° of turning about a vertical axis. The manner of mounting generally involves a yoke which spans said wheel in engagement with opposite extremities of the wheel's horizontally disposed axle, and pivotably engages an overhead support. In the preferred embodiment of the improved wheelchair of the present invention, when the rear caster wheels are activated to support the wheelchair, said wheelchair is capable of movement in any direction whether or not the drive wheels are removed because it is supported by four caster wheels. In such state, movement of the wheelchair is accomplished by the occupant by applying pulling or pushing force to nearby objects such as walls in a confined area.

The lever-operated jacking apparatus may be installed onto newly manufactured wheelchairs designed to accommodate said jacking apparatus, or said jacking apparatus with slight structural modification, may be adapted for installation onto existing conventional wheelchairs.

By virtue of the above-delineated structural details, the present invention embraces the following major features:

(1) It provides a wheelchair which can be converted to a mode having omnidirectional movement.

(2) Said conversion can be achieved by the occupant of the wheelchair without aid, and preferably by way of a single rapid manipulation.

(3) The above two features can be accomplished by virtue of a mechanical device attachable to conventional wheelchairs.

(4) When the wheelchair is in its omnidirectional mode, the large side wheels can optionally be removed by the occupant without aid, causing the wheelchair to have a narrower configuration better suited for negotiation of narrow passageways.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
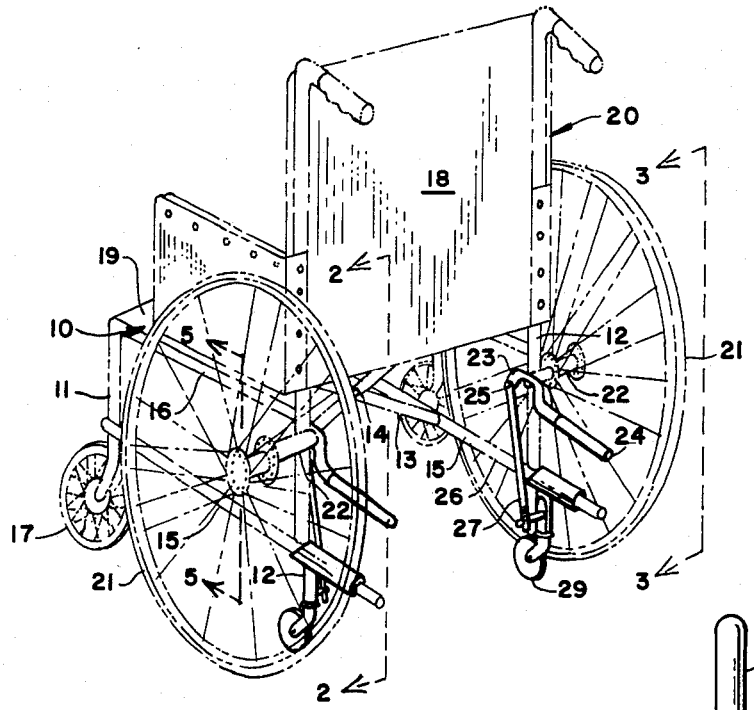
FIG. 1 is a rear perspective view of a wheelchair equipped with an embodiment of jacking apparatus of the present invention, showing said wheelchair in its upwardly jacked position.

Referring to FIG. 1, a wheelchair is shown comprised of a metal tubular frame 10 having paired front vertical posts 11 and paired rear vertical posts 12. Diagonal support members 13 extending between lower horizontal connecting members 15 and upper horizontal connecting members 16 of frame 10 are interengaged by pivot pin 14 which enables the wheelchair to undergo a folding-type motion causing lateral compaction thereof. Front caster wheels 17 engage the lowermost extremities of front vertical posts 11. Situated rearward and above front caster wheels 17 is seating means 20 comprised of back sling 18 and seat sling 19 fabricated of compliant web-like materials and supported by portions of said frame. A pair of spoked rear drive wheels 21 having horizontally disposed hubs 22 and associated axles 30 are adapted for rotation in vertical planes about said axles.

Figure 2:
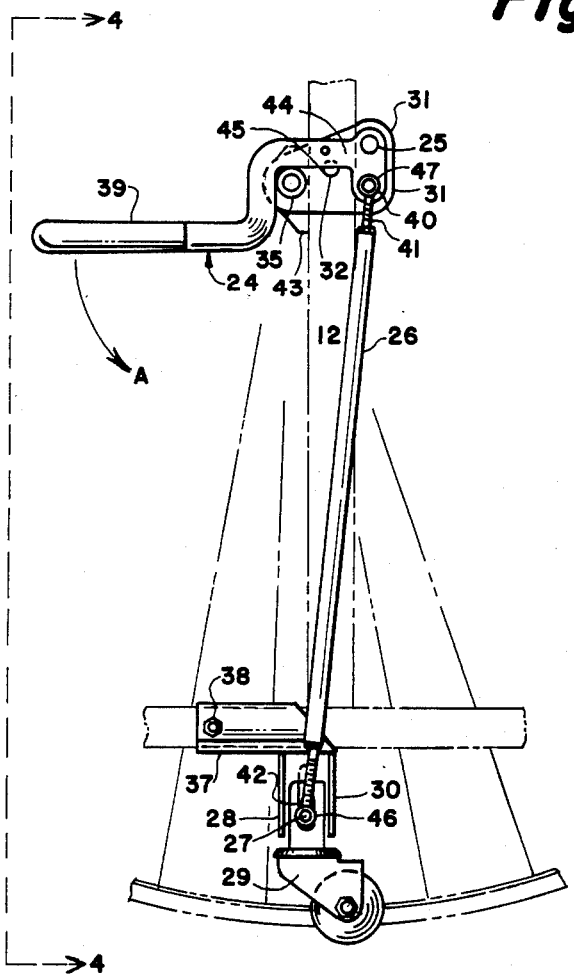
FIG. 2 is an enlarged fragmentary sectional view taken along the line 2—2 of FIG. 1, showing the wheelchair in its upwardly jacked position.
Figure 3:
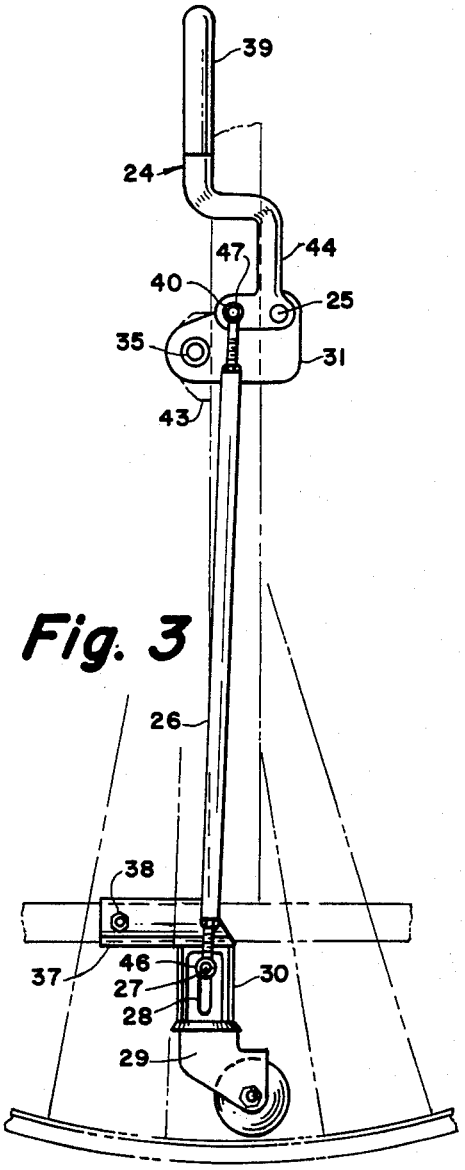
FIG. 3 is an enlarged fragmentary side view taken along the line 3—3 of FIG. 1 with the drive wheel removed and showing the wheelchair in its lower, unjacked position.
Figure 4:
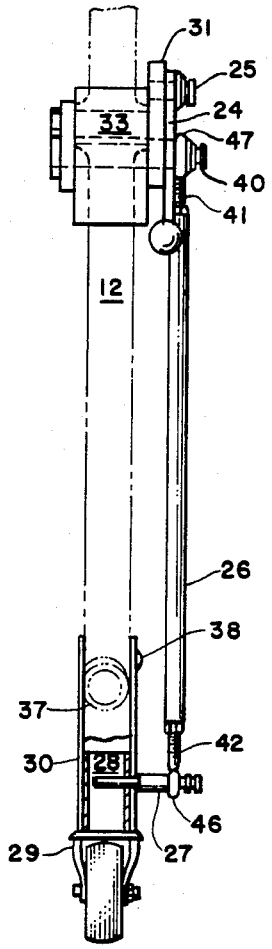
FIG. 4 is a side view taken along the line 4—4 of FIG. 2.

A lever-operated jacking device 23 is associated with each rear vertical post 12 on the innermost or facing sides of said posts. The exemplified embodiment of jacking device shown in detail in FIGS. 2–4 is designed to be applied as an accessory feature to conventional wheelchairs. Said jacking device is comprised of a support bracket 31 adapted to be fastened to post 12 by bolt 32 which penetrates channel 33 in said post and is secured by thread in bracket 31. A buttressing protrusion 43 affixed to bracket 31 engages post 12 to prevent rotation of said bracket about bolt 32. An axle housing 35 in said bracket disposed within protrusion 43 and parallel to channel 33 is adapted to provide journalled support for axle 30 of drive wheel 21. Actuation means represented by lever 24 is attached to bracket 31 by first pivot means 25, thereby permitting pivotal movement of said lever in a vertical plane. The forwardmost portion of said lever is designated action portion 44, and the rearwardmost portion of said lever is designated handle 39. A vertical connecting rod 26 is pendantly attached by a second pivot means comprised of bushing 47 and pin 40 attached to said lever in action portion 44. The lowermost extremity of said vertical connecting rod engages a third pivot means comprised of bushing 46 and horizontally disposed pin 27 attached to column 28 which supports rear caster wheel 29. Column 28 is adapted to telescopically engage tubular housing 30 pendantly supported by sleeve 37 fitted onto horizontal connecting member 15 and joined thereto by bolts 38.

In the illustrated embodiment, connecting rod 26 is shown to be of adjustable length by virtue of upper and lower threaded engagement means 41 and 42 respectively associated with bushings 47 and 46, and which possess opposite threading and thereby enable connecting rod 26 to function in a turnbuckle manner when rotated about its long axis. To facilitate such rotation, said connecting rod may be provided with a knurled surface.

When the jacking device is activated to cause lifting, lever 24 will be in a substantially horizontal position, as shown in FIG. 2. In said position, it is important to note that first pivot means 25 is above second pivot means 40, and the lever is in abutment with the innermost extremity of axle housing 35 which emerges from the inside face 45 of buttressing protrusion 43. Such manner of abutment prevents further downward movement of handle portion 39. The position of the second pivot means with respect to the first pivot means, and the angle of connecting rod 26 between said second and third pivot means are such that forces directed upwardly from rear caster wheel 29 urge lever 24 in the direction of abutment with axle housing 35. Such factors of design and construction thereby constitute locking means which concertively act to maintain lever 24 in a fixed horizontal position. The elements of said locking means comprise an abutment means such as axle housing 35, and a force emanating from rear caster wheel 29 and transmitted to said second pivot means in a manner serving to pivot said lever about said first pivot means in the direction of said abutment means. Properly directed force transmission to the second pivot means may be secured by either proper placement of the second pivot means with respect to the first pivot means, or proper angle of the connecting rod.

The distance of separation between the centers of said first and second pivot means is essentially the distance between the uppermost and lowermost positions of the rear caster wheel. It is to be noted that, when lever 24 is in its upright position as shown in FIG. 3, first and second pivot means are centered on a substantially horizontal line.

Although the invention has been exemplified primarily in terms of an embodiment wherein the jacking apparatus may be added to an existing conventional wheelchair, it is to be understood that the same inventive principles may be applied to a wheelchair specifically manufactured to incorporate the features of the jacking apparatus herein described. In said latter instance, the rear caster wheel, instead of being mounted on a sleeve-like fitting adapted to fit onto the lower horizontal connecting member, may be telescopically fitted to an extension of rear vertical post 12 below said lower horizontal connecting member. Furthermore, certain features of the bracket member may be incorporated into vertical post 12. In any embodiment of the jacking apparatus of this invention, it is preferable to locate the rear caster wheel no closer to the front of the wheelchair than the axles of said drive wheels, the reason being to prevent the wheelchair from toppling over rearwardly.

Braking means, operable by the seated occupant of the wheelchair may be provided to afford greater control over the motion of the wheelchair when it is in its jacked-up mode and capable of omnidirectional movement. Such braking means may be lever-activated devices which cause frictional restraint between the frame and the ground or rear caster wheels.

Figure 5:
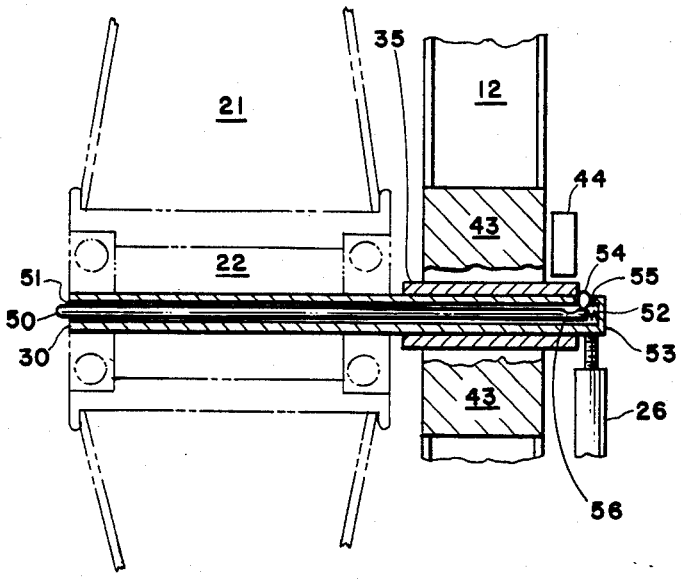
FIG. 5 is an enlarged sectional view taken along the line 5—5 of FIG. 1.

The quickly detachable drive wheels utilized in the preferred embodiment of wheelchair of the present invention are of standard manufacture. In FIG. 5, which schematically illustrates the general features of a detachable drive wheel, a sliding rod 50 positioned within channel 51 in axle 30 rests in abutment with untensioned spring 52 confined in the closed end 53 of axle 30. A detent 54 which extends outwardly from axle 30 and communicates with channel 51 is associated with a tensioned spring 55 which maintains a force on detent 54 tending to draw it inwardly toward channel 51. The inner end of said detent is normally in abutment with the cylindrical surface of rod 50, said abutment causing the outer end of said detent to protrude from axle 30. However, when rod 50 is pressed toward the closed end of axle 30, a depressed portion 56 is brought beneath detent 54. Such action causes detent 54 to temporarily enter axle 30, thereby releasing axle 30 and its associated drive wheel from fixed engagement with axle housing 35.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In a wheelchair comprised of a frame having paired front and rear vertical posts which define an interior region of said frame and paired upper and lower horizontal connecting means extending between front and rear posts, paired front caster wheels mounted on said frame adjacent said front posts, seating means disposed within said interior region generally behind and above said front caster wheels, and a pair of drive wheels rotatably supported by said rear vertical posts on the exterior of said frame on opposite sides of said seating means and adapted to rotate in vertical planes about horizontally disposed axles, said drive wheels being equipped with quick disconnect means, said front caster and drive wheels being adapted to support said wheelchair at four sites for rolling motion upon an underlying substantially planar support surface, the improvement comprising jacking apparatus associated with each rear vertical post, said apparatus being comprised of a rear caster wheel which engages said frame in a manner to be vertically positionable between uppermost and lowermost positions, a lever having an active portion, and a handle portion positioned within reach of a seated occupant of said wheelchair, said active portion being associated with said frame by first pivot means permitting about 90° of movement of said lever in a vertical plane between upright and lower positions, vertical connecting means having an upper extremity attached by second pivot means to said active portion and a lower extremity associated by third pivot means with said caster wheel, and locking means which act to cause said lever to be maintained in said lower position, whereby when said lever is in its lower position, said rear caster wheel is displaced downwardly by said connecting means to its lowermost position, and when said lever is in its upright position, said rear caster wheel is in its uppermost position, said lowermost position of said rear caster wheel being such as to cause the associated drive wheel to be lifted out of contact with the support surface while placing said rear caster wheel in contact with said support surface, the movement of said lever between said lower and upright positions being achievable by said seated occupant and whereby, when said lever is in its lower position, the seated occupant can unaidedly remove said drive wheels from the frame and return them thereto.

2. The wheelchair of claim 1 wherein said jacking apparatus is located substantially within the interior region of said frame.

3. The wheelchair of claim 1 wherein the distance between said first and second pivot means is substantially equal to the distance between the uppermost and lowermost positions of said rear caster wheel.

4. The wheelchair of claim 1 wherein said second pivot means is below said first pivot means when said lever is in its lower position.

5. The wheelchair of claim 4 wherein said second pivot means is centered slightly forwardly of the center of said first pivot means when said lever is in its lower position.

6. The wheelchair of claim 1 wherein said rear caster wheel is located below the lower horizontal connecting means of said frame.

* * * * *